United States Patent [19]

Megerle

[11] 4,337,927

[45] Jul. 6, 1982

[54] FURNACE INSTALLATION PARTICULARLY FOR THE MELTING OF ORE CONCENTRATE

[75] Inventor: Friedrich Megerle, Cologne, Fed. Rep. of Germany

[73] Assignee: Klöckner-Humboldt-Deutz AG, Fed. Rep. of Germany

[21] Appl. No.: 177,740

[22] Filed: Aug. 13, 1980

[30] Foreign Application Priority Data

Sep. 1, 1979 [DE] Fed. Rep. of Germany ..... 2935394

[51] Int. Cl.[3] ..... F27D 1/12

[52] U.S. Cl. ..... 266/190; 266/193; 266/229; 165/56; 165/136; 432/83

[58] Field of Search ..... 266/189, 190, 193, 194, 266/152, 227, 229, 230; 165/56, 136; 432/83

[56] References Cited

U.S. PATENT DOCUMENTS

| | | | |
|---|---|---|---|
| 475,614 | 5/1892 | Schumacher | 266/229 |
| 2,554,836 | 5/1951 | McFeasters | 266/230 |
| 2,914,398 | 11/1959 | Johnston | 266/190 |
| 3,555,164 | 1/1971 | Kostin et al. | 373/78 |
| 3,632,235 | 1/1972 | Worner | 266/229 |

FOREIGN PATENT DOCUMENTS

| | | | |
|---|---|---|---|
| 2812280 | 10/1978 | Fed. Rep. of Germany | 266/230 |

*Primary Examiner*—Brian E. Hearn

*Attorney, Agent, or Firm*—Hill, Van Santen, Steadman, Chiara & Simpson

[57] ABSTRACT

A furnace assembly of the type used for melting of ore concentrate, wherein at least one separating wall is provided within the confines of the furnace to dip into the melt and divides the furnace space into separate melting, settling, and exhaust spaces. The specific improvement of the present invention involves providing a separating wall which is composed of individual metallic cooling elements in a stacked arrangement with each cooling element being provided with means for passing a coolant therethrough.

5 Claims, 7 Drawing Figures

FURNACE INSTALLATION PARTICULARLY FOR THE MELTING OF ORE CONCENTRATE

BACKGROUND OF THE INVENTION

1. Field of the Invention

This invention is in the field of furnace assemblies in which separating walls are used to isolate melting, settling and exhaust spaces in the furnace, the separating walls being provided with means for circulating a coolant therethrough which means are integrated with the exterior walls of the furnace assembly.

2. Description of the Prior Art

In the case of known pyrometallurgical furnace installations such, for example, as shown in U.S. Pat. No. 3,555,164, finely divided ore concentrate is continuously roasted and melted in a melting aggregate in an oxygen-rich gas atmosphere. The melt is separated from the gas which is formed, as well as from dust, in a melting chamber. The gas and dust are drawn off into an exhaust gas shaft which is adjacent to the melting chamber, while the melt and slag which has collected on the floor of the melting chamber pass into a settling hearth for further treatment of the melt and removal of the slag which passes under a furnace separating wall depending from above into the melt bath.

The furnace walls which come into contact with the hot corrosive gases as well as with the hot metal or with the slag must be completely fireproof and have to be cooled. In the case of the known furnace installations, for example, the separating wall which depends from above into the melt bath and which extends over the entire width of the furnace for the separation of the melt collecting space from the settling hearth is a hollow wall provided with cooling pipes. If the furnace separating wall extending over the total furnace width consists of a single piece, then the separating wall is no longer transportable and erectable due to its substantial weight and size. Thermal stresses in such a separating wall cannot be compensated for. If, on the other hand, the furnace wall were in the form of a bricked structure, the erosion by means of the corrosive slag melt would be excessive. It is inherently obvious that such a wall would have to be cooled and in addition would have to be embodied in a self-supporting structure.

SUMMARY OF THE INVENTION

The present invention provides a means for avoiding the disadvantages of the prior art and for creating a furnace installation including separating walls which are subject to high thermal stresses, and which display a high degree of strength despite the cooling pipes which are present internally in such walls. The walls are erectable without difficulty, and compensate for thermal stresses, and in addition provide other advantages.

In accordance with the present invention, the furnace walls and in particular the furnace separating walls in the interior of the furnace consist of individual metallic cooling elements which have means for passing cooling medium through them, the cooling elements being positioned in a stacked arrangement.

In a further feature of the invention, each cooling element includes upwardly and downwardly extending projections which provide means for interconnecting such cooling elements. In a further feature of the present invention, the cooling elements take the form of T-shaped elements arranged in superimposed relation. The design of metal cooling elements in the shape of a T-type beam provided with cooling pipes has the advantage that when such cooling elements are stacked one on top of the other, there are simultaneously two furnace separating walls provided, a frontal beam wall which can form the separating wall separating the melting space from the exhaust gas and settling spaces, and the shank portion of the T-shaped beam running transversely to the frontal beam forms a separating wall between the melt space and the exhaust gas space of the furnace installation.

The individual metallic cooling elements of the present invention, in comparison to a one-piece cooling wall, have a low weight thereby faciliating transport and assembly. Through the use of the particular shape and structure of the cooling elements, by means of their connecting cross-pieces, a heat stress equalization of the furnace separating wall is possible, particularly in the case of different thermal loads on opposite sides of the wall. The improved beam-shaped cooling elements need not extend over the total height of a furnace separating wall but rather they can be present only in the lower wall region which is subject to the greatest thermal stresses. Consequently, the improved cooling elements of the present invention are particularly suited as supporting structure or as load-bearing structure which is solid enough to be able to support a tank or boiler wall or another wall over it.

BRIEF DESCRIPTION OF THE DRAWINGS

The invention and its further advantages will be explained more completely with the use of a schematically illustrated furnace assembly according to the present invention.

Figure 3:
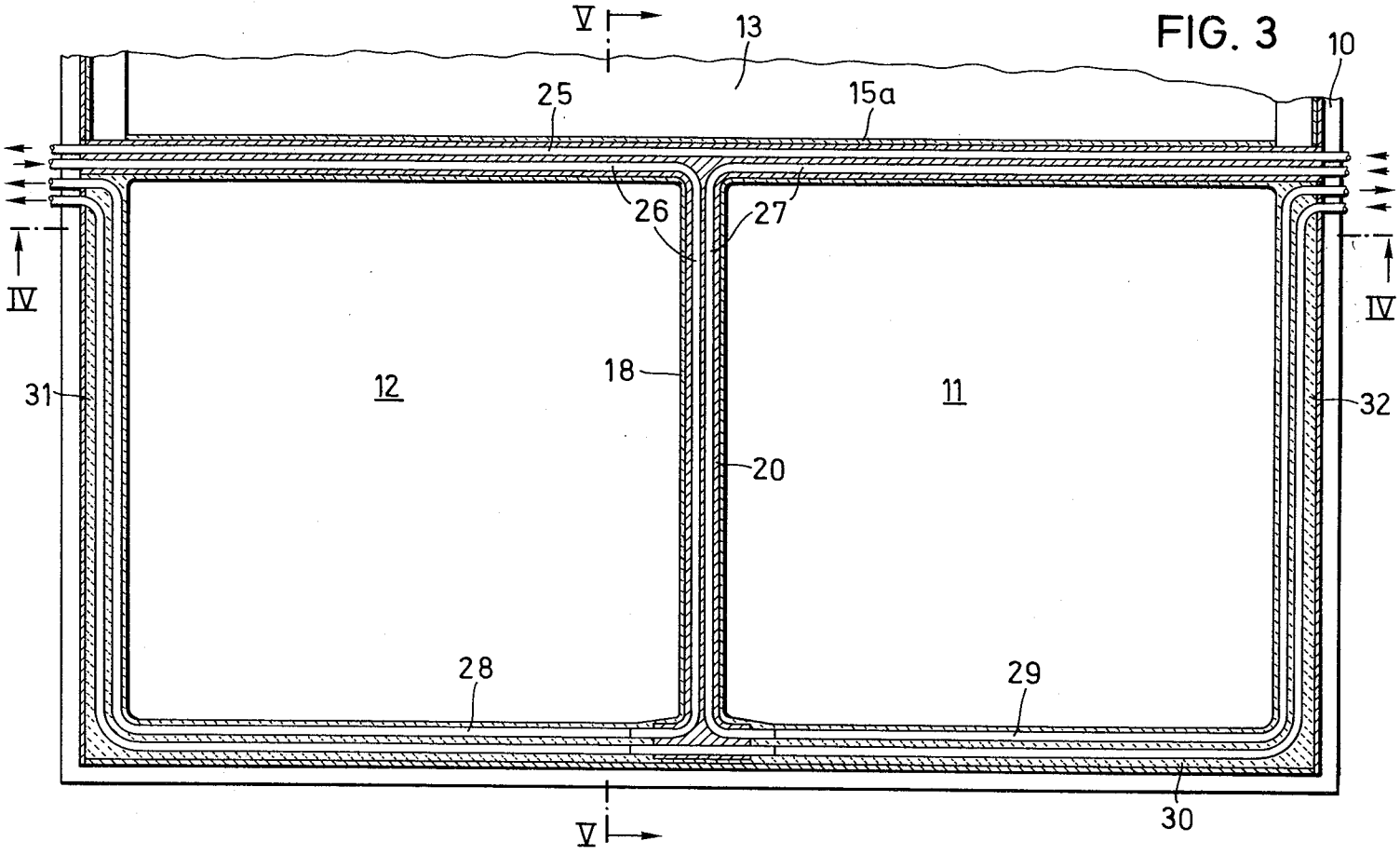
FIG. 3 is a horizontal cross section taken through a furnace assembly embodying the improvements of the present invention, along the lines III—III of FIG. 4.
Figure 4:
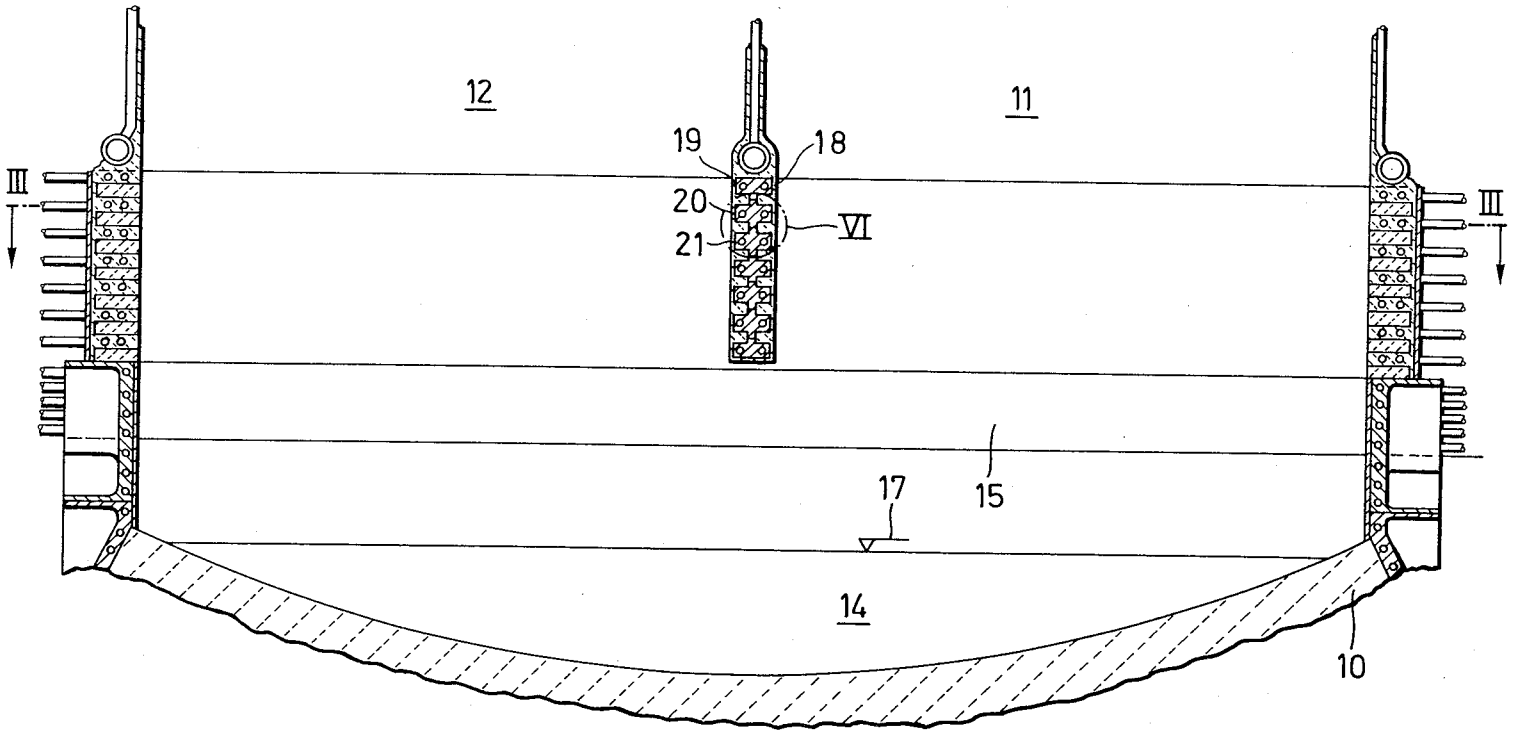
FIG. 4 is a vertical cross-sectional view through the furnace installation along the lines IV—IV of FIG. 3.
Figure 5:
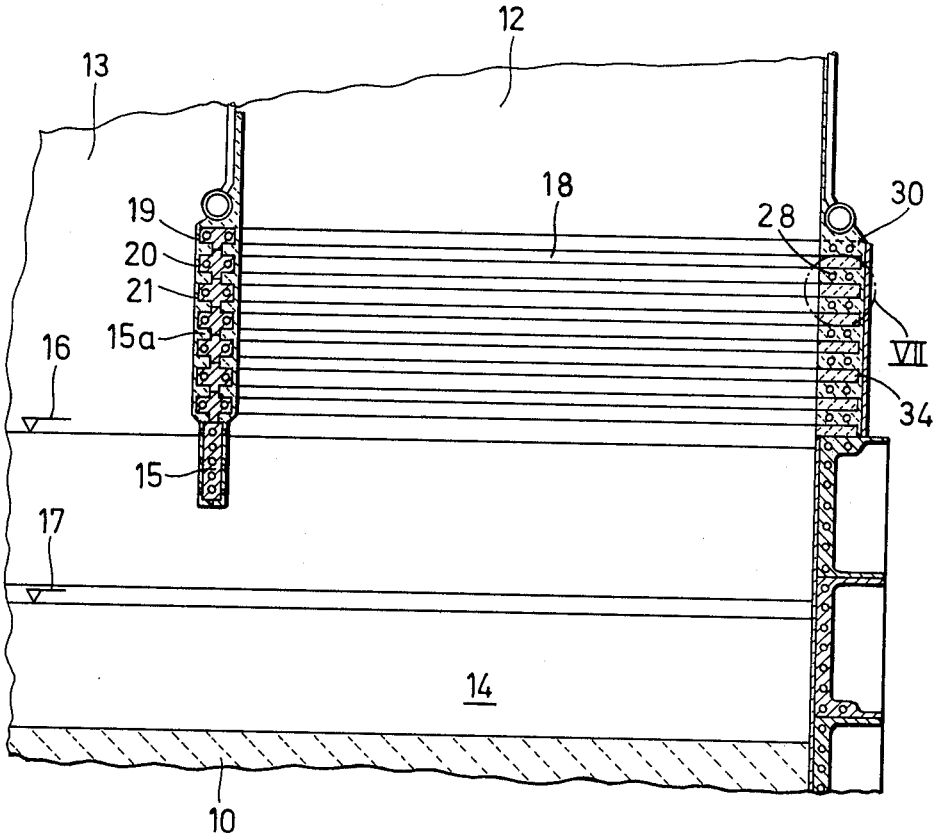
FIG. 5 is a vertical cross-sectional view taken along the line V—V of FIG. 3.

The overall furnace assembly is best illustrated in FIGS. 3 through 5 and these figures will be considered first. The figures show a pyrometallurgical furnace installation which, for example, can be used for the smelting of fine grained sulfidic lead ore concentrate. The furnace includes a common housing 10 in which there are arranged a suspension melting shaft or space 11, an exhaust shaft or space 12, and a settling hearth or space 13 for the further treatment of the melt. In the vertical melting space 11, the sulfidic ore concentrate is blown in from above with a stream of technically pure oxygen.

The ore concentrate is roasted and melted in the melting space during momentary heating to a high temperature in fractions of a second while it is still suspended. The combustion of the sulfide sulfur and other oxidizable constituents in the oxygen atmosphere usually provides sufficient heat for the maintenance of the roasting and melting processes autogenously. The melt collects in the melt collection space 14 while the exhaust gas together with dust which is formed is drawn up through the exhaust space 12. In the collecting space 14, a primary slag forms on the collected melt. The melt flows under the lower edge of a vertical separating wall 15 which dips into the melt bath or into the slag bath from above into the settling hearth 13. In the hearth 13, the melt is reduced and separates into lead and secondary slag which are drawn out of the settling hearth 15 separately.

The slag bath surface 16 and the lead bath surface 17 are at equal height in the melt collecting space 14 and in the settling space 13. The separating wall 15 prevents the mixing of gases from the oxidation zone and the reduction zone, and makes it possible to maintain an atmosphere in each zone independent of the other.

By means of a furnace separating wall 18, the melt space 11 and the exhaust gas space 12 are separated from each other. In the space between the slag bath surface 16 and the lower edge of the furnace separating wall 18, exhaust gas is drawn off from the melt space 11 into the exhaust gas space 12.

The two vertical furnace separating walls which are perpendicular to one another such as shown at 15*a* and 18 are very highly loaded thermally and must of necessity be cooled. These two furnace separating walls according to the present invention are composed of metallic cooling elements 19, 20, and 21 which are provided with cooling medium pipes. The elements in each case have the shape of a one-piece T-beam, and are stacked over each other along their shank portions. The T-beam shaped cooling elements 19, 20, 21, have their head portions forming the separating wall 15*a* which dips into the melt for the separation of the melt space 11 from the exhaust gas space 12 or the settling hearth 13. The shank portion of the T-shaped elements run crosswise to the frontal beam wall portion, to form a separating wall 18 between the melt space 11 and the exhaust gas space 12.

The beam-shaped cooling elements along their central longitudinal axes are provided with connecting cross-pieces which project upwardly and downwardly as shown at reference numerals 22, 23, and 24. By such means, adjoining cooling elements can be connected together as by means of welding which is clearly shown in FIG. 6.

Figure 6:
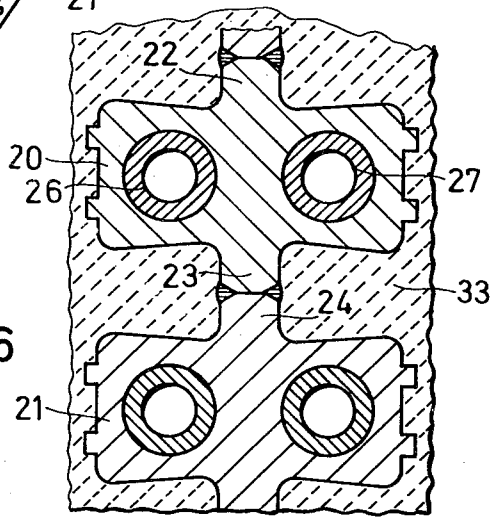
FIG. 6 is an enlarged view of detail VI from FIG. 4.
Figure 1:
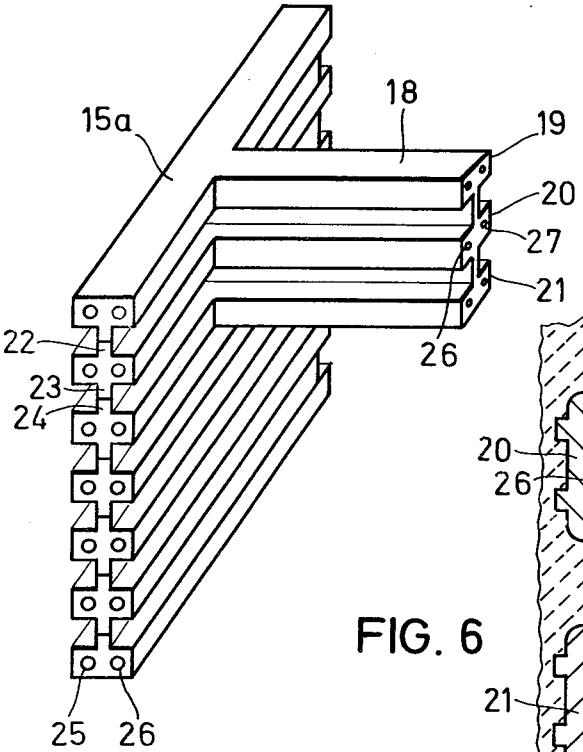
FIG. 1 is a view in perspective of furnace separating walls which are composed of individual cooling elements each of T-shaped configuration.
Figure 2:
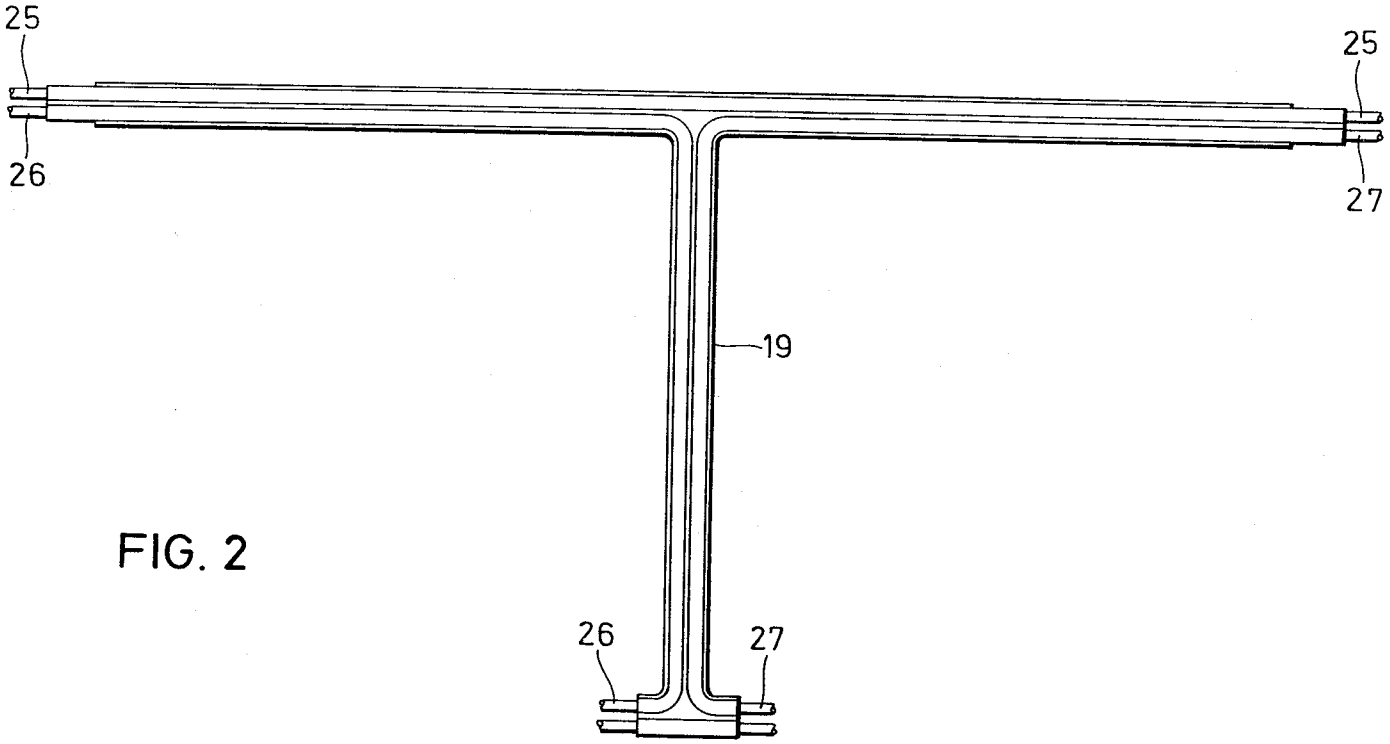
FIG. 2 is a plan view of a T-shaped cooling element.

Each cooling element includes a cooling medium pipe on both sides of the vertical central longitudinal plane as seen in cross section in FIG. 6. In combination, the T-shaped cooling elements contain three continuous cooling medium pipes, one such pipe 25 running along the entire length of the frontal beam, and two other pipes 26 and 27 running through a frontal beam half and then through the shank portions which are perpendicular to it, all of which is best illustrated in FIGS. 2 and 3.

The T-shaped cooling elements may consist of copper and may be provided with water conveying pipes 25, 26 and 27 also consisting of copper. The cooling elements can, however, consist of steel or other metal depending upon which type of ore concentrate is being melted in the furnace. The cooling water passage in each case through the cooling medium pipes 25, 26 and 27 is indicated clearly by the arrows in FIG. 3. As apparent from FIG. 4, the wall unit which is constructed from the T-type beams in a cantilever fashion is supported only on the three end points of the beam. Connecting pipelines are connected to the cooling pipes 25, 26 and 27 and all three end points of the T-shaped cooling elements. Connecting pipelines 28 and 29 are embedded in fireproof material of the furnace exterior walls 30, 31, and 32 which are thermally loaded to a lesser extent so that the furnace separating walls 15*a*, 18 which are highly thermally loaded are correspondingly greatly cooled, whereas the furnace exterior walls which connect to the furnace separating walls which are thermally loaded to a lesser extent are correspondingly cooled to a lesser extent as a result of the lack of metallic cooling beam material in these furnace exterior walls. The heat transfer from the furnace walls can therefore be adjusted individually, according to the thermal loading of the walls, by means of including more or less metallic cooling beam material in the wall.

Figure 7:
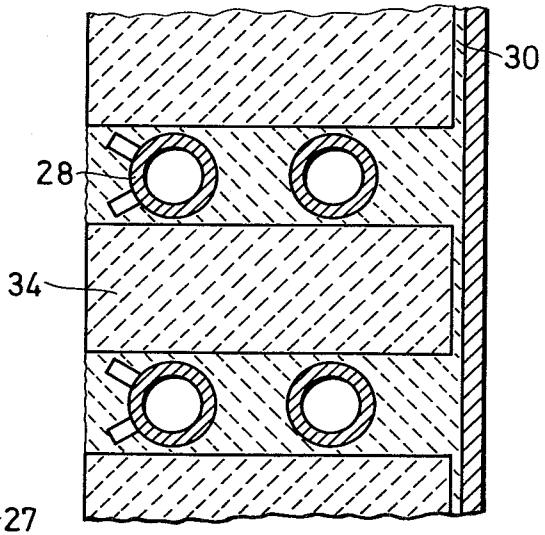
FIG. 7 is an enlarged view of detail VII from FIG. 5.

The spaces between adjoining cooling elements 19, 20, and 21 are filled with fireproof material 33. The spaces can also be filled up with fireproof blocks. The exterior surfaces of the furnace separating walls can be protected by means of fireproof packing. As shown in FIG. 7, in a furnace exterior wall 30, the space between cooling pipes lying over one another may be filled with fireproof blocks 34 and the remaining interstitial spaces can be packed with fireproof material.

The advantages which are attainable with the use of the invention consist mainly in that the individual metallic cooling elements have a low weight in comparison to a one-piece cooling wall, whereby transport and assembly are greatly simplified, and a type of prefabricated assembly can be used. By means of the shape and structure of the cooling elements, and their connecting cross-pieces, a heat stress equalization of the furnace separating walls is possible, particularly in the case of different thermal loading on both sides of the walls. The improved beam-shaped cooling elements need not extend over the total height of the furnace separating wall but can extend only over its lower region of high thermal loading so that the furnace wall structure is ideally suited as supporting structure or as load-bearing structure which is solid enough so that masonry, walls, or other structural elements can be built over it. In the case of furnace separating walls which are built from T-shaped cooling elements, the frontal beam wall which extends over the entire furnace width of, for example, 8 meters in a cantilever manner is kept stable in the critical middle region of the shank wall which runs transversely through the frontal beam wall, whereby the furnace structure is improved as a whole with regard to its stability. By means of the height of the connecting cross-pieces, and the spacing of the individual beam-shaped cooling elements from one another, the heat removal can be adjusted through the furnace separating wall. For example, the spacing of the cooling elements from one another can become greater from the lower side of the wall to the upper side of the wall, corresponding to the thermal as well as mechanical stresses of the furnace wall which decrease from the bottom toward the top.

It will be evident that various modifications can be made to the desired embodiments without departing from the scope of the present invention.

I claim as my invention:

1. In a furnace of the type used for melting of ore concentrate, including exterior side walls and at least one separating wall positioned intermediate said side walls and arranged to dip into the melt to divide the furnace space into separate melting, settling and exhaust spaces, the improvement which comprises:

said separating wall being composed of individual metallic cooling elements in a stacked arrangement, each of said cooling elements being T-shaped, said cooling elements being arranged in super-imposed relation, and each cooling element being provided with means for passing a coolant therethrough.

2. A furnace according to claim 1 in which the heads of the T-shaped elements form a separating wall between said melting space and the settling and exhaust spaces, and the shanks of said T-shaped elements form a separating wall between the melting and exhaust spaces.

3. A furnace according to claim 1 in which: said T-shaped cooling elements are suspended in cantilever fashion only from their three ends.

4. A furnace according to claim 1 which includes: cooling pipes running throughout the entire lengths of said heads and a pair of cooling pipes running along the shanks.

5. A furnace according to claim 4 which includes: conduit means connecting said pair of cooling pipes to the exterior walls of said furnace.

* * * * *